United States Patent [19]

Daly et al.

[11] Patent Number: 4,938,713

[45] Date of Patent: Jul. 3, 1990

[54] ELECTRICAL TERMINAL FOR WAVE CRIMP TERMINATION OF FLAT POWER CABLE

[75] Inventors: John K. Daly, Scottsdale, Ariz.; William B. Fritz, Hummelstown, Pa.; Earl R. Kreinberg, Phoenix, Ariz.

[73] Assignee: AMP Incorporated, Harrisburg, Pa.

[21] Appl. No.: 338,242

[22] Filed: Apr. 14, 1989

Related U.S. Application Data

[63] Continuation of Ser. No. 193,852, May 13, 1988, Pat. No. 4,859,204, and a continuation of Ser. No. 194,063, May 13, 1988, Pat. No. 4,859,205, and a continuation of Ser. No. 298,259, Jan. 13, 1989, Pat. No. 4,867,700, which is a continuation of Ser. No. 193,458, May 13, 1988, abandoned, which is a continuation-in-part of Ser. No. 50,793, May 14, 1987, abandoned, and a continuation of Ser. No. 236,313, Aug. 23, 1988, Pat. No. 4,834,673.

[51] Int. Cl.[5] ..... H01R 9/07

[52] U.S. Cl. ..... 439/492; 439/497; 439/422

[58] Field of Search ..... 439/389–393, 439/395, 401–403, 409, 410, 421–424, 492–499; 29/857, 861, 863, 865, 866, 867

[56] References Cited

U.S. PATENT DOCUMENTS

| | | | |
|---|---|---|---|
| 2,759,161 | 8/1956 | Berg | 339/97 |
| 3,201,744 | 8/1965 | Dean | 339/97 |
| 3,247,316 | 4/1966 | Weimer, Jr. | 174/94 |
| 3,259,873 | 7/1966 | Parkinson et al. | 339/97 |
| 3,541,227 | 11/1970 | Bendrick | 174/94 |
| 3,599,173 | 8/1971 | Bridle | 339/99 |
| 3,668,613 | 6/1972 | Klosin | 339/97 C |
| 3,706,121 | 12/1972 | Gillespie | 29/203 H |
| 3,728,473 | 4/1973 | Kuo | 174/84 C |
| 3,754,204 | 8/1973 | Raitport et al. | 339/32 R |
| 3,825,881 | 7/1974 | Wigby | 339/97 R |
| 3,851,294 | 11/1974 | Palazzetti et al. | 339/17 F |
| 3,854,787 | 12/1974 | Snyder, Jr. | 339/103 R |
| 3,881,796 | 5/1975 | Saunders | 339/97 C |
| 4,012,101 | 3/1977 | Damoisiaux et al. | 339/97 C |
| 4,059,897 | 11/1977 | Marquis | 29/432.1 |
| 4,082,402 | 4/1978 | Kinkaid et al. | 339/97 C |

(List continued on next page.)

FOREIGN PATENT DOCUMENTS

| | | |
|---|---|---|
| 0285344 | 10/1988 | European Pat. Off. . |
| 1957183 | 6/1970 | Fed. Rep. of Germany . |
| 7239900 | 3/1973 | Fed. Rep. of Germany . |
| 2228780 | 1/1974 | Fed. Rep. of Germany . |

OTHER PUBLICATIONS

AMP Data Sheet 74–279 Issued 7–84, "AMP Termi--foil Terminals and Splices", AMP Incorporated, Harrisburg, Pa.

*Primary Examiner*—David Pirlot

[57] ABSTRACT

A transition adapter for terminating flat power cable includes at least a stamped and formed member having opposed plate sections between which an end or an edge portion of the cable is receivable to be terminated. The plate sections have opposing cooperating terminating regions comprised of a plurality of alternating wave shapes and relief recesses, with each wave shape aligned with a recess of the opposing terminating region. When the plate sections are urged together under sufficient force, shearing edges along each side of each wave shape shear the cable conductor by cooperating with shearing edges of the adjacent wave shape of the opposing terminating region, scissors-fashion. Crests of the wave shapes deflecting the sheared cable portions into the opposing relief recesses, forming a series of interlocking wave joints across the intermeshing terminating regions and terminating the cable between the plate sections. The wave crests deflect integral strips of conductor out of the plane of the cable, exposing sheared conductor edges for electrical connection therewith such as with solder. Softer metal insert members may be secured to and along outer surfaces of the plate sections to engage and form gas-tight electrical connections with substantial surface areas of the sheared conductor edges.

5 Claims, 8 Drawing Sheets

U.S. PATENT DOCUMENTS

| | | | |
|---|---|---|---|
| 4,106,836 | 8/1978 | Asick et al. | 339/97 C |
| 4,241,498 | 12/1980 | Brandeau | 29/861 |
| 4,248,493 | 2/1981 | Kuo | 339/97 R |
| 4,285,561 | 8/1981 | Chow | 339/14 R |
| 4,326,764 | 4/1982 | Asick et al. | 339/14 R |
| 4,352,531 | 10/1982 | Gutter | 339/14 R |
| 4,371,225 | 2/1983 | Narozny | 339/97 C |
| 4,451,099 | 5/1984 | Bricker, Jr. et al. | 339/14 R |
| 4,457,576 | 7/1984 | Cosmos et al. | 339/143 R |
| 4,602,831 | 7/1986 | Lockard | 339/14 R |
| 4,655,515 | 4/1987 | Hamsher, Jr. et al. | 339/14 R |
| 4,669,798 | 6/1987 | Daum et al. | 439/423 |
| 4,769,896 | 9/1988 | Denlinger et al. | 29/509 |
| 4,772,212 | 9/1988 | Sotolongo | 439/98 |
| 4,773,878 | 9/1988 | Hansell, III | 439/497 |

ELECTRICAL TERMINAL FOR WAVE CRIMP TERMINATION OF FLAT POWER CABLE

REFERENCE TO RELATED APPLICATION

This is a Continuation Application of U.S. patent applications Ser. Nos. 07/193,852 and 07/194,063 filed May 13, 1988 now U.S. Pat. Nos. 4,859,204 and 4,859,205, and Ser. No. 07/298,259 filed Jan. 13, 1989, Patent No. 4,867,708 which is a Continuation Application of Ser. No. 07/193,458 filed May 13, 1988 now abandoned which was a Continuation-in-Part Application of U.S. patent application Ser. No. 07/050,793 filed May 14, 1987 now abandoned and continued as Ser. No. 07/236,313 filed on Aug. 23, 1988, Patent No. 4,834,673.

FIELD OF THE INVENTION

The invention relates to electrical terminals and more particularly to the termination of terminals to flat power cable.

BACKGROUND OF THE INVENTION

U.S. Pat. No. 4,834,673 discloses a transition adapter which is secured onto a flat power cable by being crimped thereto, and the adapter includes one or more contact sections to be engaged with corresponding contacts of an electrical connector to transmit power from the cable to the connector. The cable is of the type entering commercial use for transmitting electrical power of for example 75 amperes nominal, and includes a flat conductor one inch wide and about 0.020 inches thick with an extruded insulated coating of about 0.004 to 0.008 inches thick over each surface with the cable having a total thickness averaging about 0.034 inches. The metal of the flat conductor is for example of Copper Alloy 110 and the insulation is for example TEFZEL thermoplastic resin known as polyethylene-co-tetrafluoro-ethylene copolymer (trademark of the E. I. DuPont de Nemours and Company, Wilmington, Del.).

The transition adapter of includes a pair of plate sections hinged together at the forward or terminal end of the adapter, and a still-insulated end or edge portion of the cable is to be crimped therebetween. At a selected location forwardly of the cable-crimping region at least one of the plate sections is bent at an angle away from the other so that the plate sections are facing each other at an angle and are thus spaced apart to receive the cable end or edge therebetween. A plurality of lances extend from one plate section toward corresponding apertures in the other so that upon pressing the plate sections together the lances penetrate through the cable. The lances are then received through the apertures and the ends thereof are bent over and against the outer surface of the other plate section, being bent over by tool means or by being curled around by integral arcuate guides at each aperture. By penetrating the cable a plurality of electrical connections are formed between the adapter and sheared conductor edges of the cable. By being stamped from sheet metal of an appropriate alloy, the lances are preferably defined by shear edges and penetrate through the insulation and also the conductor of the cable in cooperation with the lance-receiving apertures which preferably include at least one shear edge against which the cable is pressed during penetration by the lances. Additional electrical connections are made by a plurality of barbs which penetrate the cable insulation to engage and bite into the cable conductor.

It is desirable to provide an adapter having means for shearing through a flat power cable conductor at a plurality of locations to provide a plurality of electrical connections between the adapter and the cable conductor wherein the connections are and remain gas-tight by reason of stored energy.

It is also desirable to provide each gas-tight connection with substantial surface area of engagement between the adapter and the cable's conductor.

It is further desirable to provide elongated gas-tight connections to provide greater interconnecting metal surface area.

It is yet further desirable to provide mechanical and electrical connective joints between an adapter and a flat cable which remain strong and viable and do not weaken over long-term in-service use.

It is still further desirable to provide an adapter of a metal alloy compatible with transmission of electrical power and which retains its stamped and formed shape and its shear edges to penetrate the cable, and also to provide an adapter of a metal alloy capable of assuming a shape upon termination to the cable which maximizes surface area engagement with the sheared edges of the cable conductor while retaining stored energy to maintain the gas-tight nature of the connections during long-term in-service use.

SUMMARY OF THE INVENTION

The present invention is an adapter crimpable to a flat power cable by penetrating the insulation covering the cable's conductor and also shearing through the conductor at a plurality of locations. The adapter is stamped and formed of sheet metal and includes a pair of opposed plate sections to be disposed along both major surfaces of the cable upon termination and which include respective opposed terminating regions transversely thereacross, which are formed of one or preferably several spaced wave shapes. When the plate sections are urged toward each other and against the insulated flat cable, the wave crests begin to deflect the engaged cable portions into relief recesses of the opposing plate section; simultaneously the shearing edges at ends of the wave crests penetrate and tear the insulation covering and begin shearing the portions of the cable adjoining the crest-deflected cable portions which in turn allows substantial further deflection by the wave crest and also elongation of the crest-deflected conductor portions. The sheared conductor edges of the crest-deflected cable portions are thus pushed out of the plane of the cable and are exposed along substantial lengths such as 0.25 inches to be electrically joined such as by being soldered to the adapter, or by a soft copper adapter portion being staked and thereby deformed tightly against the exposed conductor edges. The plate section maintains a mechanical attachment to the cable by reason of the end portions shearing edges of the wave shapes tightly engaging the sheared edges of the cable conductor at the ends of the crest-deflected conductor portions; additional retention means may be used such as conventional lances penetrating the cable and bent over along the far side, or tabs bent over about the side edges of the cable.

In a second embodiment, the adapter includes a body member having a pair of opposed plate sections each having at least one terminating region transversely thereacross, with the terminating regions of the opposed plate sections being associated in opposing pairs. Each terminating region of the pair is formed of alternating wave shapes and relief recesses, and the plurality of wave shapes of one plate section extend toward the other plate section and are spaced from each other by the relief recesses, with the wave shapes of one plate section corresponding with the relief recesses of the other. Each wave shape includes a transverse radiussed crest extending between parallel axially aligned shearing edges which are perpendicular with respect to the crest. Essentially the wave shapes of one plate section would intermesh with those of the other if urged toward each other, but preferably essentially with zero clearance.

The transition adapter is terminated to a cable disposed between the plate sections, by the plate sections being pressed tightly together with the cable therebetween. The opposed plate sections are integrally joined at a cable-receiving end by a hinge comprising two hinge sections spaced apart transversely a distance wide enough to define a slot for an end portion of the flat cable to be inserted therethrough and disposed between the hinge sections.

Each wave shape of the transition adapter will be forced against an adjacent surface portion of the cable and its crest will deflect that adjacent surface portion of the cable out of the plane of the cable and will stretch the conductor portion thus deflected. Simultaneously, the shearing edges of that wave shape cooperate with the shearing edges of the adjacent wave shapes of the opposed plate section: the shearing edges are aligned under zero clearance and pair up so that when the wave shapes are forced against the opposite surface of the cable, the paired shearing edges penetrate and tear the insulating layers and shear the conductor perpendicularly to the wave crest. Preferably an arcuate relief shape is formed at each relief recess extending away from the other plate section, and each wave shape is received into a corresponding opposed relief recess with the crest-deflected cable portion disposed between the wave's crest and the inner surface of the opposed arcuate relief shape. Portions of each shearing edge of the wave shapes of one plate section of the adapter engage newly formed edges of the cable conductor sheared by the adjacent wave shapes of the other plate section. The cable conductor is sheared at a plurality of locations for axial shear lengths of for example 0.25 inches and substantially without great bulk deformation of the metal thereof during the shearing process. Also since the shearing is axial with respect to the cable when the adapter is terminated on an end of the cable, the cable is not materially weakened. Essentially the intermeshing adapter wave shapes form a plurality of interlocking wave joints with the cable conductor thus defining a strong termination transversely across the cable, with the opposing plate sections acting as a zero clearance tool and die which will resist opening thereafter.

According to an aspect of the present invention, a pair of insert members are preferably affixed to and predisposed against the outwardly facing surfaces of the respective plate sections of the stamped and formed adapter body member of the second embodiment, along and across the terminating or wave regions thereof. Each insert member is shaped to conform to the wave region of the associated plate section by having conforming wave shapes and by having apertures within which the arcuate relief shapes are disposed. Each insert member is formed of high copper content alloy and is malleable so that after shearing the cable, each wave shape of the insert member may for example be deformed by a staking operation. Each wave shape of the insert member would be staked from the outwardly facing surface of the insert member to expand the wave shape tightly and fully against the sheared edges of the cable conductor now beside that wave shape on both sides, and also against the adjacent shearing edges of the adjacent wave shapes of the adapter body member. The insert members are adapted to establish the primary electrical connections to the cable conductor, while the transition adapter body member provides the strong mechanical means of attachment to the cable.

It is an objective of the present invention to provide an adapter for terminating to flat power cable which is easily applied without cable preparation, which results in an assured electrical and mechanical connection to the cable.

It is another objective to provide gas-tight joints between the adapter and the cable conductor which retain substantial stored energy thereat for long-term in-service use and do not relax due to heat and vibration over time.

It is also an objective of the present invention to provide an adapter which selectively deforms the cable in cooperation with the shearing of a plurality of locations for substantial lengths without materially weakening the cable conductor, to expose the sheared conductor edges for the forming of a plurality of electrical connections having substantial surface area.

It is yet another objective to provide an adapter which includes a metal portion stiff enough to be capable of including edges for shearing through a relatively thick (0.020 inches) metal conductor at a plurality of locations for substantial lengths, while including a metal portion capable of being formed to conform tightly against substantially the entire surface area of the sheared conductor edges with stored energy after cable penetration.

It is still another objective to provide an adapter which after cable termination distributes current carried by the conductor evenly to selected contact sections in an assured manner.

It is an object of the invention to provide a transition adapter with integral means to resist torque from prying the plate sections apart and thus to relieve and protect the termination.

Embodiments of the present invention will now be described with reference to the accompanying drawings.

DETAILED DESCRIPTION OF THE PREFERRED EMBODIMENT

Figure 1:
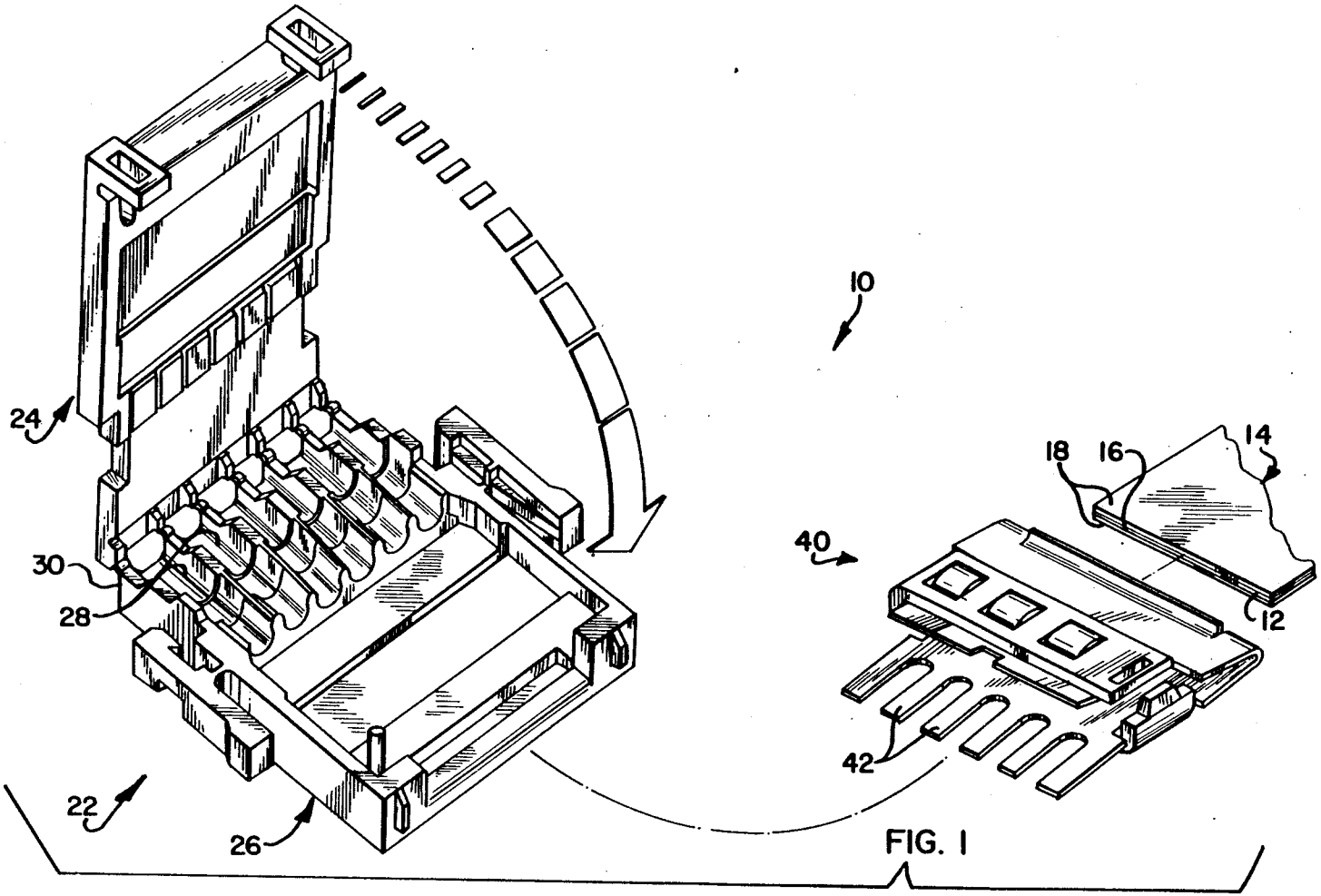
FIG. 1 illustrates an electrical connector for flat power cable utilizing the transition adapter of the present invention.

FIG. 1 illustrates the connector assembly 10 in which the transition adapter 40 of the present invention is used to terminate an end 12 of flat power cable 14 for a power distribution system for within electronic devices such as computers, copying machines and the like, and also for card cage systems such as that disclosed in U.S. Pat. No. 4,846,699, Cable 14 is of the type comprising a flat conductor 16 such as 0.020 inches thick copper or aluminum with an insulative coating 18 extruded therearound, such as four to eight mils thickness of TEFZEL thermoplastic resin (trademark of E. I. DuPont de Nemours and Company) along each surface. After application of transition adapter 40 onto cable end 12, the terminated end is secured within a dielectric housing assembly 22 comprising first and second cover members 24,26 for example. Cover members 24,26 can be hinged to facilitate being rotated together and latched to enclose the terminated cable end. Passageways 28 extend inward from mating face 30 to contain the contact sections of the adapter for mating to corresponding contacts (not shown). The housing assembly can be configured in accordance with the type of contact section or sections 42 desired to be formed on the adapter 40, and also the particular use to which the connector is to be put. A variety of contact sections for the transition adapter is disclosed in U.S. Pat. No. 4,834,673.

Figure 3:
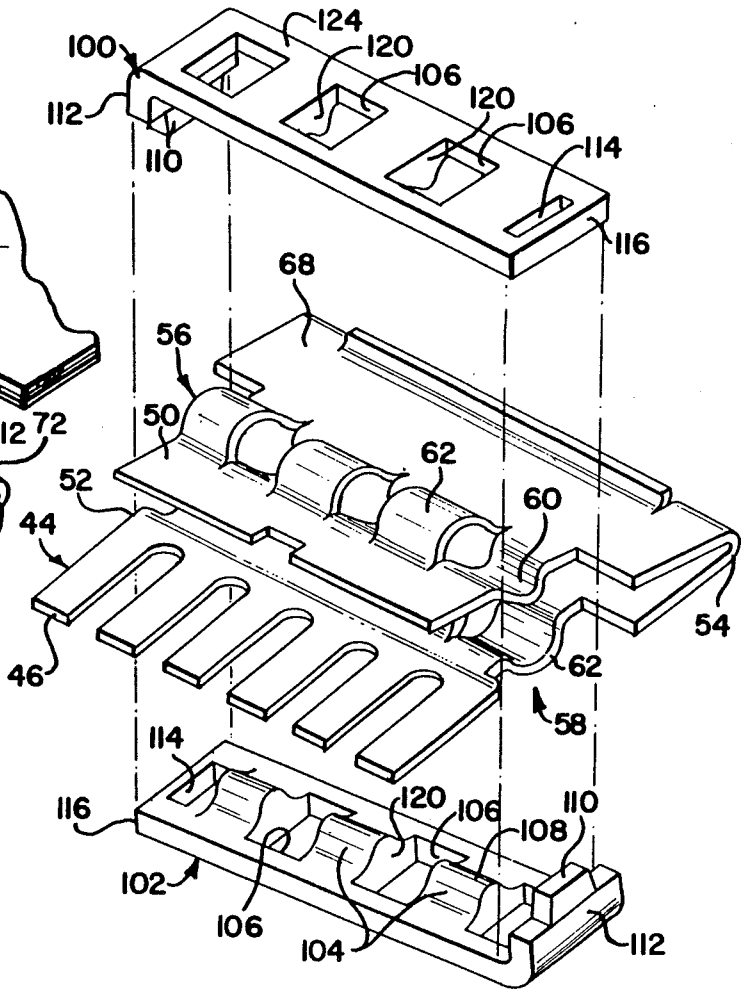
FIG. 3 is an isometric view of the adapter with the inserts exploded from the body member.
Figure 2:
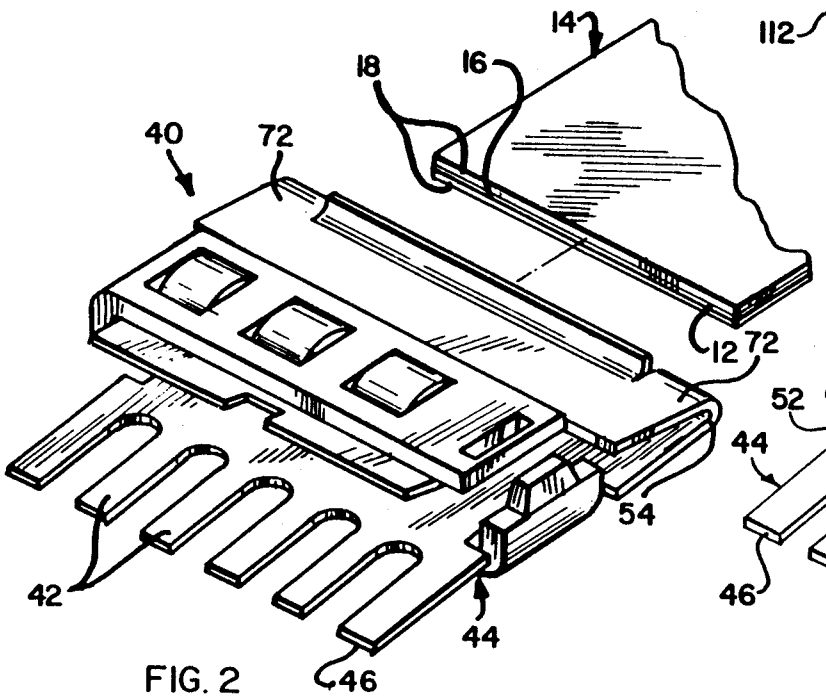
FIG. 2 is an isometric view of the transition adapter of FIG. 1 ready to receive a cable end thereinto for termination.

In FIGS. 2 and 3, transition adapter 40 of the present invention includes at least a body member 44 to which the one or more contact sections 42 are joined or are an integral part, at mating end 46. Body member 44 also includes a cable-receiving end 48 which may be at the opposite end from mating end 46. Body member 44 also includes a pair of plate sections 50,52 preferably integrally joined at hinge 54 so that the plate sections after termination will be disposed in parallel along opposed major side surfaces of cable end 12 and clamped onto cable 14. Preferably and as shown, hinge 54 is located at cable-receiving end 48 although the hinge can also be located proximate mating end 46 as seen in FIGS. 11 and 12.

Plate sections 50,52 have respective opposed terminating regions 56,58 extending transversely thereacross, each comprising a row of spaced wave shapes 60 (see FIG. 6A) alternating with relief recesses formed by arcuate relief shapes 62. Each of the wave shapes of each of the plate sections is located opposed from an arcuate relief shape of the other of the plate sections. The wave shapes of each plate section extend outwardly of the cable-proximate surface 64 thereof and toward the other plate section to radiussed crests 66 (FIG. 6A); the arcuate relief shapes extend outwardly of the cable-remote surface 68 thereof and away from the other plate section. Essentially wave shapes 60 of each of plate sections 50,52 present a cooperating pattern with wave shapes 60 of the other which are offset, and the wave shapes would intermesh if the plate sections were to be urged against each other about hinge 54.

Preferably transition adapter 40 includes insert members 100,102 to establish assured electrical connections to cable conductor 16. One method of using insert members is disclosed in U.S. Pat. No. 4,859,204. Insert members 100, 102 are affixed to cable-remote surfaces 68 of respective plate sections 50,52 of body member 44 across termination regions 56,58 thereof. Each insert member 100,102 has a pattern of wave shapes 104 alternating with relief apertures 106 likewise presenting a cooperating pattern with those of the other insert member after being secured appropriately to body member 44. Wave shapes 104 include crests 108 and are shaped to conform to the adjacent surfaces of corresponding wave shapes 60 of the plate section to which the insert member is affixed. Preferably each of insert members 100,102 includes a shaped boss 110 at one end 112 and a shaped boss-receiving aperture 114 at the other end 116 so that upon termination the shaped boss of one insert member is received into the boss-receiving aperture of the other.

Figure 6A:
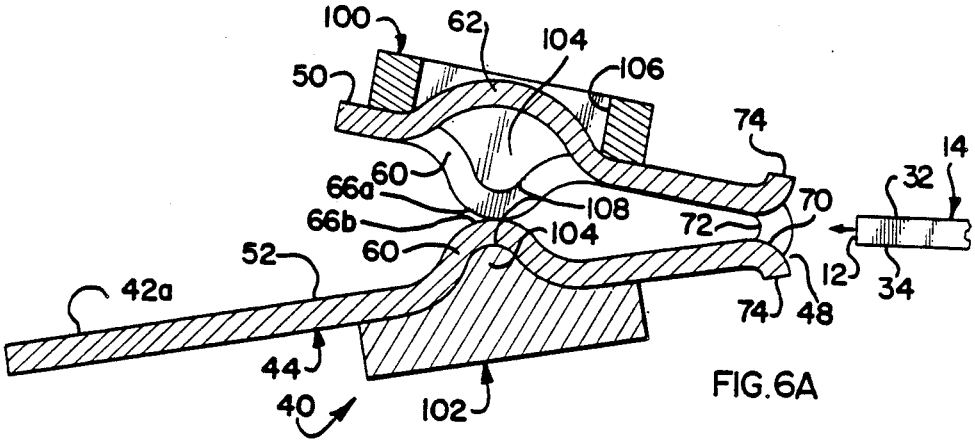
FIGS. 6A to 6C are longitudinal section views of the adapter ready to receive a cable end thereinto, after receiving the cable end, and after being terminated thereonto respectively.

In FIGS. 2 and 6A cable end 12 is insertable into cable-receiving end 48 of transition adapter 40 which preferably comprises a slot 70 (FIG. 4) extending between a pair of hinge sections 72 of body member 44 joining plate sections 50,52 as is described in U.S. Pat. No. 4,859,205 . It is preferable that plate sections 50,52 be previously bent almost together about hinge sections 72 prior to cable insertion, with crests 66 of wave shapes 60 close enough together so that the spacing therebetween has a dimension smaller than the thickness of cable 14, so that cable end 12 deflects plate sections 50,52 slightly outwardly against spring bias generated at hinge sections 72 so that transition adapter 44 self-retains onto cable end 12 to facilitate handling prior to the crimping step to follow. Torque relief of the terminations from cable torque is provided by adapter 40 being integral at the rearward portions of opposed plate sections 50,52 at cable-receiving end 48 joined by bight straps or hinge sections 72 and having a spacing therebetween sufficient to receive a cable end therebetween, the spacing being about equal to a cable thickness, and therefore cable-receiving end 48 can have a low profile. Placing integral hinges at the cable-receiving end helps resist the torque applied on the adapter by the relatively wide, relatively stiff cable. Preferably a pair of transverse tabs or flanges 74 are bent 90° about small radii out of the plane of the metal blank from which the adapter is formed, along both sides of elongated slot 70, thus actually creating the slot. Slot 70 is long enough and wide enough to receive therethrough the width and thickness of the particular flat cable 14 selected for termination by adapter 40, and the radiussed nature of the joint from which the flanges 74 extend respectively provides lead-in benefits facilitating cable insertion and won't damage the cable during handling and in-service use. Hinge sections 72 should be formed to have a radius about equal to one half of the cable thickness. Flanges 74 extend normally outwardly from the cable major surfaces 32,34 after termination and provide strength after termination to provide improved resistance to plate sections 50,52 being deflected apart resulting from torque which may be applied to the transition adapter due to stresses on the relatively wide, relatively stiff cable.

Figure 4:
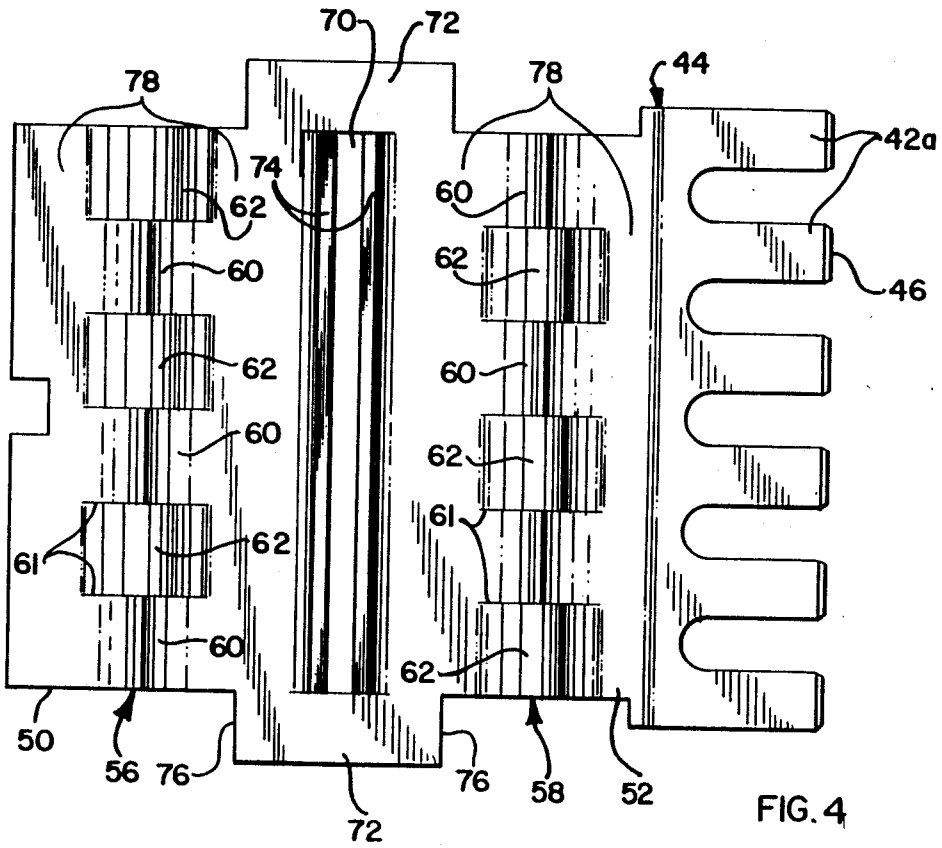
FIG. 4 is a plan view of the body member prior to its plate sections being bent back along each other.

FIG. 4 shows the metal blank of body member 44 prior to application of insert members 100,102 thereto, and prior to being bent at hinge sections 72. Blade type contact sections 42*a* are shown at mating end 46; plate sections 50,52 are shown on either side of slot 70 and flanges 74; and terminating regions 56,58 are seen to have a width across body member 44 about equal to that of a cable, with recesses 76 on either side of hinge sections 72 providing clearance for the bosses 110 of each of insert members 100,102 (FIG. 3) to extend beside body member 44 upon termination to be received in boss-receiving apertures 114 of the opposed insert member. Terminating regions 56,58 are slit at equally spaced, precisely opposed locations during the formation of the wave shapes 60 and arcuate relief shapes 62 in a manner not creating gaps laterally between the formerly joined shearing edges at slits 61. Plate sections 50,52 also include integral portions 78 forwardly and rearwardly of the ends of slits 61. Flanges 74 can be comprised of the metal formed from creating slot 70 and are bent 90° about small radii.

Body member 44 can be formed for example from strip stock of 0.025 inches thick copper alloy such as sold by Olin Corporation under Alloy No. 7025 half hard copper alloy, or such as Alloy No. 151 tempered hard alloy, Temper No. H05 with annealing for good stress relaxation properties. Insert members 100,102 can be formed for example of dead soft Copper CDA 110 generally about 0.066 inches thick with a height at the wave crest 108 of about 0.132 inches, and can have a length in the axial direction of about 0.326 inches. Both the insert members and the body member can be silver plated, if desired, to assure the integrity of the electrical connection for long-term in-service use.

Figure 5:
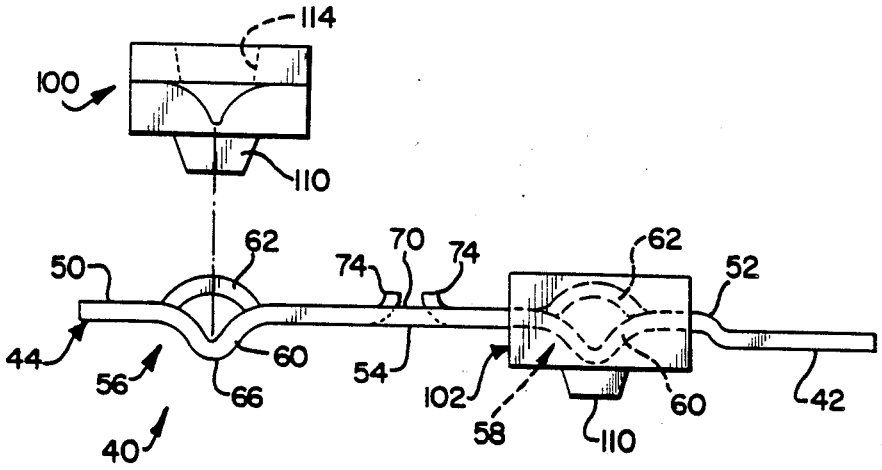
FIGS. 5 and 5A are elevation views showing the insert members being affixed to the body member, and an enlarged isometric part-sectional view thereof illustrating staking.
Figure 5A:
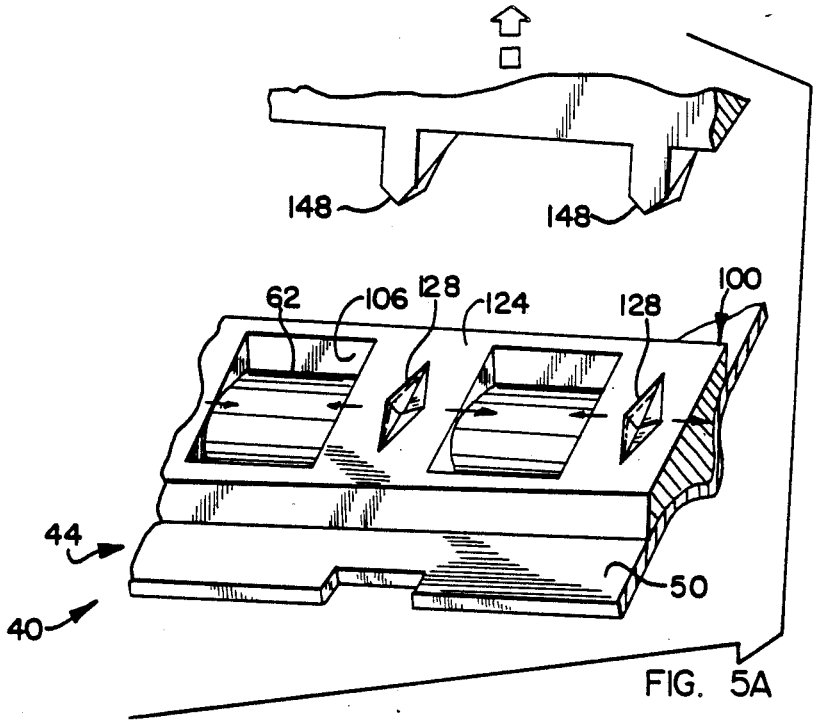

Referring to FIGS. 5 and 5A, each insert member 100,102 can be affixed to a respective plate section 50,52 by a slight staking operation wherein the insert members are tapped by blades 148 centered on the outwardly facing surface of each raised wave shape, which slightly deforms the insert wave shape laterally against the edges of the adjacent arcuate relief shapes of the particular adapter plate section to which the insert member is being secured.

Figure 6B:
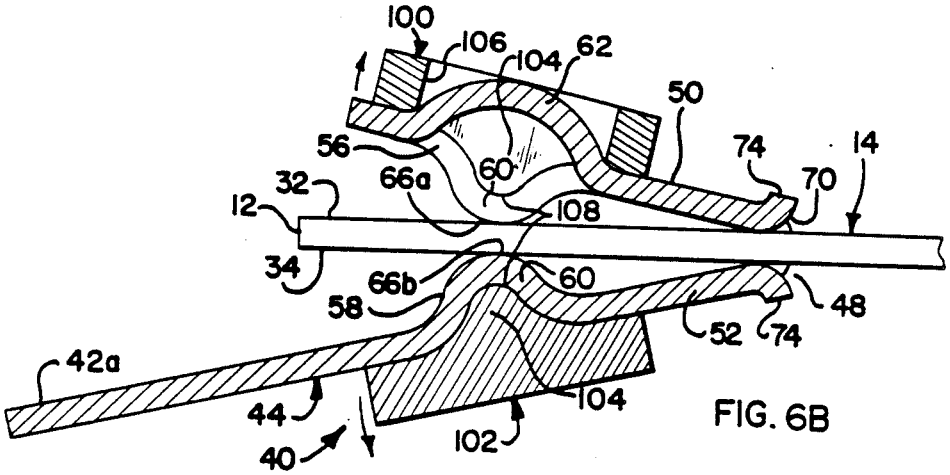
Figure 6C:
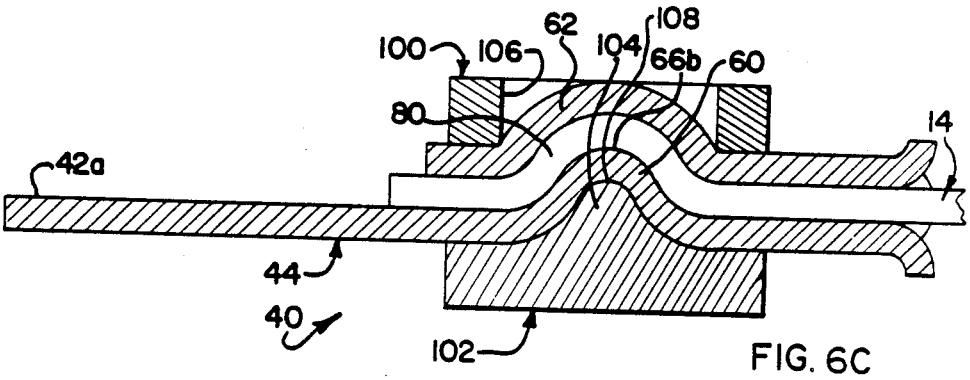

In FIG. 6A the assembled transition adapter 40 is ready to receive cable end 12 into cable-receiving end 48, and wave shapes 60 are almost together at upper and lower crests 66*a*,66*b*. The cable end is inserted into slot 70 and deflects plate sections 50,52 apart in FIG. 6B and is moved forwardly until leading edge 12 is appropriately located a small distance in front of the terminating regions 56,58 but rearwardly of contact sections 42*a*. Spring bias at hinge sections 72 creates a gripping of the cable by the crests 66*a*,66*b* against insulated upper and lower surfaces 32,34 of cable 14. In FIG. 6C the transition adapter 40 has been pressed together by tooling 150 (FIG. 7A) such as an arbor press. Shearing edges created by slits 61 along the sides of wave shapes 60 of each plate section have acted in cooperation with those of the offset wave shapes of the opposing plate section and have first punctured and torn the tough, ductile insulative coating 18 of cable 14 and have sheared the cable conductor 16 lengthwise for distances of about 0.25 inches. Crests 66*a*,66*b* have deflected outwardly and elongated the thus sheared portions of cable conductor 16 forming alternatingly upward and downward arcuate conductor loops within the opposed arcuate relief shapes of the opposing plate section. At each wave shape 60 has been formed a wave joint 80. In the present embodiment there are shown six wave joints 80 transversely entirely across cable 14, and the transition adapter of the present invention can easily be modified to create four such wave joints leaving integral adapter straps along lateral ends of the termination regions.

It is believed that the wave shapes assist the shearing of the cable by initiating the outward deflection of the cable in opposite directions first at a single point along the cable axis (by the wave crest) and then gradually axially forwardly and rearwardly therefrom and also by initiating the shearing first at that single point simultaneously with the deflection from both surfaces of the cable by paired shearing edges having zero clearance. The deflected conductor strips remain integrally joined to the cable and the cable is not materially weakened. The termination is considered to be controlled and precise and is performed by shearing edges of the adapter itself and without any prior preparation of the cable required. Another benefit of the present invention is that since the transition adapter grips the cable after cable insertion, handling to place the cable end into the application tooling is simplified since the stiff cable itself is used for manipulation.

Figure 7A:
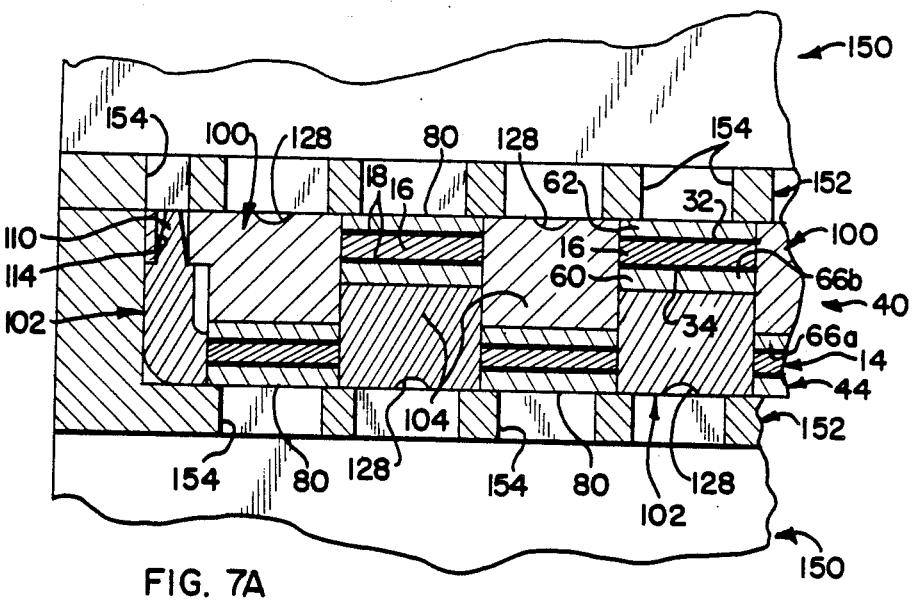
FIGS. 7A to 7C are cross-sectional views taken across the region of the wave termination showing respective shearing and two staking operations.
Figure 7B:
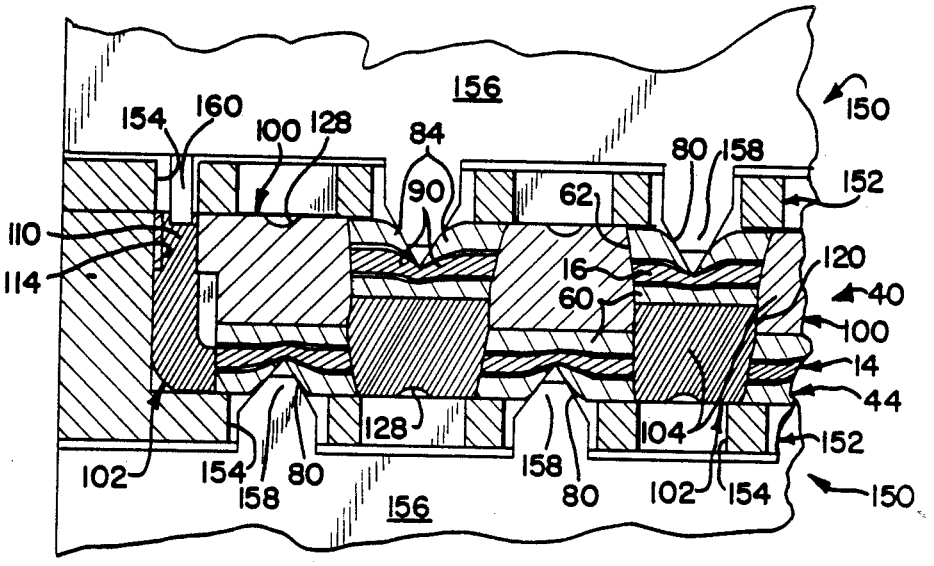
Figure 7C:
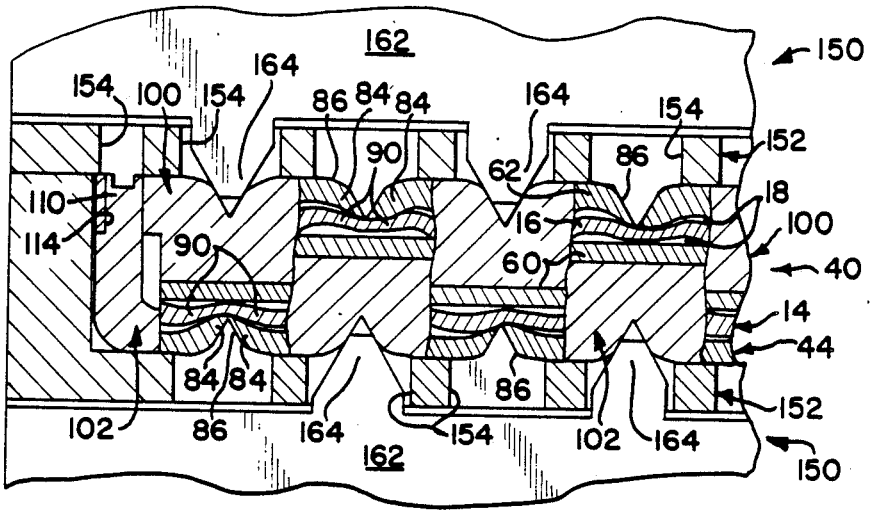
Figure 8A:
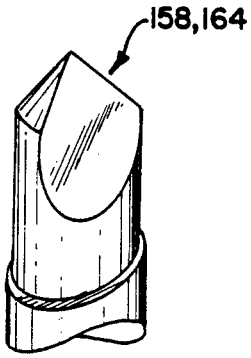
FIGS. 8A and 8B are views of the two types of staking blade tips for use in the staking operations of FIGS. 7B and 7C.
Figure 8B:
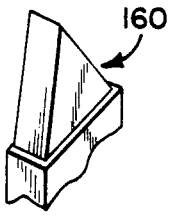
Figure 10:
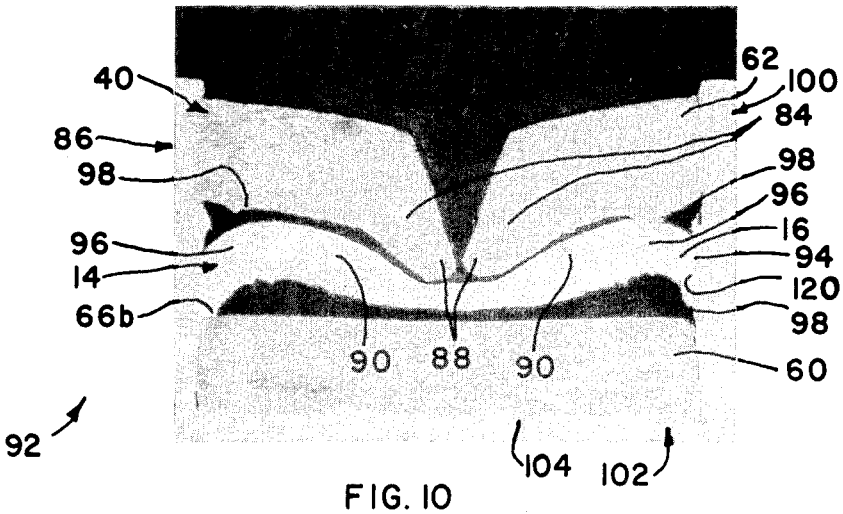

With reference to FIGS. 7A to 7C, following the application of compressive force by planar surfaces of a first pair of dies 152 of tooling 150 to shear the cable, preferably dies 152 remain locked together continually pressing most of the outer surfaces of the upper and lower portions of the transition adapter 40 against the upper and lower cable surfaces 32,34. Dies 152 may preferably have limited apertures 154 at each location of wave joint 80 and insert wave shape 104 and at both insert ends 112,116 to expose bosses 110 and the wave joints and insert wave shapes for subsequent staking operations. A second step is then performed by a second pair of dies 156 in FIG. 7B. Pointed chisel blades 158 have axially oriented tips (FIG. 8A) and simultaneously strike the transition adapter 40 from both above and below at each wave joint 80 first along the outer surfaces 82 of arcuate relief shapes 62. Referring to FIGS. 7B and 10, blades 158 penetrate into each wave joint 80 a selected depth and split the arcuate relief shapes 62 and also bend the split portions 84 down along the inside of the resultant V-shape of a staked wave joint 86 at the axial center of the wave. Split portions 84 act as paired spring members having free ends 88 which are permanently deformed by blades 158 into cable 14. With the wave crest 66 of the opposing wave 60 acting as a die, free ends 88 act on softer conductor 16 to urge portions 90 thereof laterally outwardly even though conductor portions 90 may usually remain integrally joined to each other. Spring members 84 thereafter trap conductor portions 90 against side surfaces 120 of insert member relief apertures 106 and retain them against surface 120 under spring bias, acting as stiffly compliant structures. At the same time an additional set of blades 160 (FIG. 8B) stake bosses 110 into boss-receiving apertures 114 of insert members 100,102, thereby deforming the bosses into enlarged shapes within the undercut apertures and firmly joining the inserts together at assured electrical and mechanical joints 122.

Then as is shown in FIG. 7C, as blades 158,160 are withdrawn but dies 152 remain closed, a third step is performed by a third pair of dies 162 of tooling 150. Pointed chisel blades 164 have axially oriented tips (FIG. 8A) and simultaneously strike the transition adapter 40 from above and below along the outer surfaces 124 of each insert member 100,102 at each wave shape 104 and between the now-staked wave joints 86. Blades 164 thus are pressed into the wave shapes 104 of insert members 100,102 and split and deform the softer copper material laterally and loading the contact interface between the freshly sheared edges of the cable conductor portions 90 along each staked wave joint 86 and the relief aperture side surfaces 120 of the insert members. Free ends 88 of spring members 84 also prevent the deflected conductor strips from bulging outwardly at the center during staking of the insert member wave shapes 104. Blades 158,160,164 may optionally be separate members urged into blade-receiving apertures 154 by a separate comb member (not shown).

Figure 9:
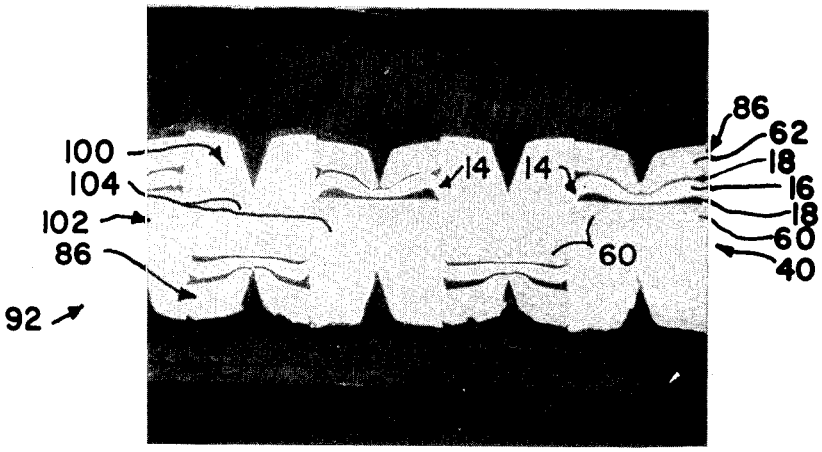
FIGS. 9 and 10 are microphotographs taken along a cross-section of a cable to which a transition adapter has been terminated as in FIGS. 7A–C, and an enlargement of a single staked wave joint thereof, respectively.

FIG. 9 is an enlarged cross-sectional view transversely through an actual termination 92 and represents the type of termination resulting from the transition adapter described with respect to FIGS. 7A to 7C. Four of the six staked wave joints 86 are seen. In FIG. 10 which is an enlargement of one of the staked wave joints 86 of FIG. 9, sheared conductor edges 94 are clearly shown tightly against adjacent side surfaces 120 of adjacent insert wave shapes forming the primary electrical connections 96 between the transition adapter and the conductor of the cable. Near the axial center of each staked wave joint 86, the conductor 16 consists of two portions 90 which have been urged laterally outwardly with sheared conductor edges 94 being impacted against surfaces 120; the curvature at 96 indicates the existence of substantial column strength creating stored energy cooperating with the adjacent staked insert portions to form an assured electrical connection. Dark layered areas 98 within staked wave joints 86 comprise portions of insulative cable covering 18 which have become lodged within available spaces and do not affect the assured mechanical and electrical connections. Measurement of resistance levels of terminations formed in this manner indicate acceptably small levels of voltage drop, indicating good electrical connections after aging at elevated temperatures. Conventional thermal shock tests indicate excellent mechanical stability in the terminations.

Although a transition adapter utilizing the wave crimp of the present invention preferably includes insert members of softer metal to optimize the termination for long-term in-service use, it is foreseeable that a transition adapter can be used without separate insert members and obtain significant benefits from the shearing action performed by the zero clearance opposing shearing edges of the wave shapes disclosed herein, and obtain wave joints which are mechanically strong and which provide substantial surface area of exposed cable conductor of the cable for establishing electrical connection therewith. Lateral edges of the wave shapes may be serrated if desired thus forming corresponding serrations in the sheared conductor edges and increasing the surface area thereof exposed for electrical connection such as by soldering. Also, insert members having a different configuration may be used. The plate sections can have two terminating regions instead of one, if desired, and can be separate members. Further, it is easily seen that an embodiment of the transition adapter can be terminated to a side edge of a flat cable rather than an end portion. Other modifications to the embodiments described herein may be made without departing from the spirit of the invention or the scope of the claims.

What is claimed is:

1. A transition adapter for flat power cable of the type having a flat conductor with a thin insulative covering thereover, for terminating to the conductor and electrically interconnecting the conductor to another electrical article having contact means matable with contact means of the adapter for the transmission of power, comprising:

at least a body member formed from metal having spring characteristics and suitable for transmitting power, said body member including contact means at a mating end thereof and opposed first and second plate sections integrally joined at a cable-receiving end by a pair of bight straps spaced laterally apart defining a transverse cable-receiving slot therebetween, said first and second plate sections coextending forwardly from said pair of bight straps and slightly diverging to receive a portion of the cable therebetween; and each of said first and second plate sections include at least one first and second terminating region respectively, said first and second terminating regions being opposed from each other prior to termination to said cable, said first and second terminating regions including opposing arrays of wave shapes such that when said first and second plate sections are pressed relatively together against a portion of the cable extending through said cable-receiving slot and disposed between said first and second plate sections, said wave shapes at least deflecting sheared conductor strips of said cable adjacent to respective ones thereof and associated therewith into opposing respective relief recesses defined by arcuate shapes associated with said wave shapes and thereby exposing sheared conductor edges for electrical connection therewith, forming a plurality of wave joints.

2. A transition adapter as set forth in claim 1 wherein first and second insert members are affixed to cable-remote surfaces of said first and second plate sections respectively at said first and second termination regions thereof, each said insert member having a surface adjoining and shaped to conform to a respective said cable-remote surface and including insert wave shapes and insert relief apertures associated and aligned with the respective said wave shapes and arcuate relief recess shapes of the said respective terminating region, each said insert wave shape extending between parallel side surfaces aligned with edges of said respective terminating region, each of said side surfaces comprising an electrical connection surface to adjoin a sheared edge of a said portion of the cable conductor after termination.

3. A termination as set forth in claim 2 wherein said insert members are staked from a cable-remote surface beside said side surfaces of each said relief aperture and thereby bulk deformed against exposed edges of said sheared and deflected conductor strips, forming gas-tight electrical connections between said exposed sheared conductor edges and adjacent ones of said side surfaces of said insert member relief apertures.

4. A termination as set forth in claim 3 wherein prior to said insert members having been staked, said wave joints have been split axially and split portions of said arcuate relief recess shapes at said wave joints comprise stiffly compliant structures, and free ends of said split portions having been deflected inwardly against and into outwardly facing surfaces of the sheared and deflected conductor strips, thereby deforming laterally outwardly the conductor strip portions engaged thereby and pressing and holding the sheared conductor edges tightly against the adjacent side surfaces of the insert member relief apertures.

5. A termination of a terminal to a flat power cable of the type having a flat conductor and a thin insulative covering thereover, comprising:

an end portion of a flat power cable;

a pair of opposing first and second plate sections of a body member disposed against major surfaces of said cable portion and having opposed terminating regions containing opposed arrays of wave shapes and arcuate relief recess shapes extending forwardly from a pair of bight straps at a cable-receiving end of the body member defining a slot through which said cable portion has been inserted, each said wave shape having at least deflected an adjacent associated sheared conductor strip out of the plane of the cable when said first and second plate sections were pressed together against said cable portion therebetween and into respective opposing said arcuate relief recess shapes, thus defining an array of wave joints; and first and second insert members affixed to cable-remote surfaces of said first and second plate members respectively adjacent respective said terminating regions, each said insert member including an array of relief apertures corresponding to and containing respective ones of said arcuate relief recess shapes and said sheared and deflected conductor strips and portions of opposing said wave shapes which deflected respective said conductor strips thereinto.

* * * * *